US010280027B2

(12) United States Patent
Eichelberg et al.

(10) Patent No.: US 10,280,027 B2
(45) Date of Patent: May 7, 2019

(54) COLLECTION SYSTEM FOR AND METHOD OF COLLECTING OBJECTS

(71) Applicant: BÖWE SYSTEC GmbH, Augsburg (DE)

(72) Inventors: Helmut Eichelberg, Buttenwiesen (DE); Helmut Koelle, Augsburg (DE); Peter Müller-Odenthal, Augsburg (DE); Heiner Kudrus, Augsburg (DE); Josef Batzer, Leitershofen (DE); Bernd Höpner, Kempten (DE)

(73) Assignee: BÖWE SYSTEC GMBH, Augsburg (DE)

( * ) Notice: Subject to any disclaimer, the term of this patent is extended or adjusted under 35 U.S.C. 154(b) by 108 days.

(21) Appl. No.: 15/068,745

(22) Filed: Mar. 14, 2016

(65) Prior Publication Data

US 2016/0297638 A1 Oct. 13, 2016

(30) Foreign Application Priority Data

Apr. 13, 2015 (DE) ..... 10 2015 105 586
Jan. 14, 2016 (DE) ..... 10 2016 100 593

(51) Int. Cl.
*B65H 31/30* (2006.01)
*B65H 29/58* (2006.01)
*B65H 39/10* (2006.01)

(52) U.S. Cl.
CPC ..... *B65H 31/3081* (2013.01); *B65H 29/58* (2013.01); *B65H 31/3027* (2013.01);
(Continued)

(58) Field of Classification Search
CPC ..... B65H 29/145; B65H 29/60; B65H 31/24; B65H 31/30; B65H 31/3027;
(Continued)

(56) References Cited

U.S. PATENT DOCUMENTS 4,177,979 A 12/1979 Orsinger et al.
4,822,025 A * 4/1989 Chung ..... B65H 31/24 209/933
(Continued)

FOREIGN PATENT DOCUMENTS

DE 9301072 U1 6/1994
DE 19718998 A1 11/1998
(Continued)

OTHER PUBLICATIONS

Result of examination report for German Patent Application No. 10 2015 105 586.4 filed Apr. 13, 2015.

*Primary Examiner* — Ernesto A Suarez
(74) *Attorney, Agent, or Firm* — Paul D. Bianco; Katharine Davis; Fleit Gibbons Gutman Bongini & Bianco PL

(57) ABSTRACT

A collection system for collecting flat objects, including a plurality of collection trays disposed one on top of the other, each of the collection trays having an entrance and an exit; a feeder unit for feeding individual objects or assembled groups of objects to the entrance of the collection trays and for depositing the supplied objects in the respective collection tray, the feeder unit and collection trays being movable or swivelable relative to one another; a conveyor unit for removing the objects deposited in a collection tray through the exit of the respective collection tray; and a movable retaining element, which closes the entrance of one of the collection trays after an individual object or an assembled group of objects has been deposited in the respective collection tray. All of the objects collected in the collection trays are simultaneously removed from the collection trays by a conveyor unit and stacked.

16 Claims, 9 Drawing Sheets

(52) U.S. Cl.
CPC ..... *B65H 39/10* (2013.01); *B65H 2301/4213* (2013.01); *B65H 2301/4478* (2013.01); *B65H 2404/2615* (2013.01); *B65H 2404/725* (2013.01); *B65H 2404/731* (2013.01); *B65H 2405/332* (2013.01); *B65H 2701/182* (2013.01); *B65H 2701/18271* (2013.01)

(58) Field of Classification Search
CPC ..... B65H 31/3081; B65H 31/309; B65H 31/3072; B65H 39/07; B65H 39/11; B65H 39/05; B65H 39/042; B65H 2301/4217; B65H 2301/42266; B65H 2405/332; B65H 2408/112; B65H 2408/1121; B65H 2408/1143
USPC ..... 271/287, 300, 302
See application file for complete search history.

(56) References Cited

U.S. PATENT DOCUMENTS 5,083,769 A * 1/1992 Young, Jr. ..... B65H 29/145 270/58.02
5,131,644 A * 7/1992 DuBois ..... B65H 39/11 271/220
5,244,200 A 9/1993 Manzke
5,435,534 A 7/1995 Linkowski et al.
5,445,368 A * 8/1995 Lester ..... B65H 29/145 270/59
6,161,828 A * 12/2000 Sussmeier ..... B65H 29/60 270/45
6,189,880 B1 2/2001 Besold
6,644,657 B2 * 11/2003 Wright ..... B65H 29/145 271/242
7,121,544 B2 * 10/2006 Masotta ..... B65H 29/145 271/182
9,617,090 B2 * 4/2017 Takahashi ..... B65H 31/24
2014/0027979 A1 1/2014 Stasson et al.
2014/0312559 A1 * 10/2014 Kidoh ..... B65H 31/10 271/176
2015/0307295 A1 10/2015 Takahashi et al.

FOREIGN PATENT DOCUMENTS

EP 0655983 A1 6/1995
WO 2014076943 A1 5/2014
WO WO-2014076943 A1 * 5/2014 ..... B65H 31/24

* cited by examiner

COLLECTION SYSTEM FOR AND METHOD OF COLLECTING OBJECTS

FIELD OF THE INVENTION

The present invention relates to a collection system for collecting flat objects in the form of a stack and to a method of collecting flat and, in particular, sheet-shaped objects in the form of a stack in a collection system.

BACKGROUND

Collection systems for collecting flat objects, e.g., sheets or envelopes made of paper or flat cards made of a paperboard or plastic material, and forming stacks of individual objects or subgroups of such objects are well known from the prior art. For this purpose, for example, assembling lines can be used, which lines comprise a conveyor unit with a plurality of collecting points disposed one behind the other, at which collecting points the objects are deposited in stacks and removed by the conveyor unit. The objects are stored in feeder stations which are disposed above and along the conveyor unit in such a manner that the objects can be deposited at the defined collecting points. This type of assembling line is known, for example, from U.S. Pat. No. 4,177,979 B. However, collecting flat objects in the form of stacks by means of such an assembling line is time-consuming and not very flexible. In order to deposit the objects at a predefined collecting point along the assembling line, the function of the feeder stations has to be synchronized, for example, by means of a complex mechanical coupling, such as is described in U.S. Pat. No. 4,177,979, to ensure that the feeder stations can deposit the objects stored therein correctly positioned at the predefined collecting points along the assembling line. The prior-art assembling lines allow the objects to be stacked only in a stacking direction from the bottom to the top, i.e., using such an assembling line, the objects can be collected only in an ascending direction in the form of a stack of objects and be deposited at the collecting points along the assembling line.

Also known from the prior art are stationary collecting stations which are able to receive serially supplied objects which are collected in the form of a stack and subsequently removed. Such stationary collecting stations again allow the objects supplied to be collected in a stack only in an ascending order in the sequence of their arrival at the collecting station. With this system, the formation of subgroups is possible.

To allow flat objects, such as sheets, to be stacked in the descending order as well, i.e., from the top to the bottom, collection systems with movable switching elements are known from the prior art, which switching elements are able to divert objects serially transported along a transport line into different directions so that the objects diverted from the original transport direction can be deposited either onto the top surface of a sub-stack already present in a collection tray or can be pushed under the sub-stack. This allows the objects to be collected in a stack both in an ascending as well as in a descending order. Collection systems of this type are known, for example, from DE 93 01 072 U1 and EP 0 655 983 B1. However, these collection systems with a switchable diverting device have a complex design structure and are susceptible to faults when in operation. Difficulties can arise when a group or subgroup comprising a plurality of single sheets is pushed under an already deposited sub-stack, for example, when the sheets have punched holes or notches. Because of the weight of the sub-stack and high friction between the upper surface of the objects or the subgroup of objects to be pushed under the sub-stack and the lower surface of the already present sub-stack, it is often difficult to slide the objects or subgroups of objects under the sub-stack without kinking the objects. In this type of collection systems, difficulties arise when stacks are to be formed in the descending order, in particular, with folded sheets, especially when these sheets have different folding lengths. When sliding a subgroup of folded sheets or a single folded sheet under a previously stacked sub-stack, there is a risk that the folded sheets will become entangled with one another, which can ultimately lead to a sheet jam in the collection system or to damage to the sheets.

Disclosed in U.S. Pat. No. 5,435,534 is a system for and a method of folding and collecting paper sheets, said paper sheets first being individually fed to a dual collection system by means of a conveyor unit. The dual collection system comprises two collection trays disposed one on top of the other, each of which trays defines a collection plane. To deposit a paper sheet supplied by the conveyor unit into one or the other collection tray, a switchable control element is disposed between the conveyor unit and the collection trays, which switchable control element routes the arriving paper sheets either into the upper or into the lower collection tray. Disposed downstream of the dual collection system is a folding device, by means of which the sheets collected in the form of stacks in the dual collection system can be folded. Since the folding device is able to fold only stacks of sheets with a limited height, an entire group of sheets, which, for example, is to be inserted into an envelope, is first divided into two subgroups by depositing them in the two collection trays of the dual collection system, with a first subgroup being deposited in the upper collection tray and a second subgroup in the lower collection tray of the dual collection system, each subgroup being deposited in the form of a stack. After dividing the group of sheets into the first and the second subgroup, first the second subgroup is removed from the lower collection tray and fed to the folding device disposed downstream in which first the second subgroup is folded and subsequently forwarded to an additional collection unit having a single collection tray. Subsequently, the first subgroup is removed from the upper collection tray of the dual connecting system and supplied to the folding device in which also the first subgroup is folded and ultimately deposited onto the folded stack of the second subgroup in the additional collection unit. The stacks of sheets deposited in the collection trays of the dual collection system are removed one after the other from the respective collection tray and fed to the folding device downstream thereof. This process is time-consuming and slows down the stacking procedure. As a result, the throughput of the collection system is reduced.

In collection systems comprising a plurality of collection trays disposed one on top of the other, an additional problem is that, while being deposited into one of the collection trays, the objects which are frequently supplied at very high speeds in a range of several meters per second bounce back because of the high kinetic energy and as a result thereof can block the entrance of the tray or even fall out of the collection tray.

SUMMARY

Taking this as the starting point, the problem to be addressed by at least some of the embodiments of the present invention is to make available a collection system, by means of which flat objects can be reliably collected in the form of stacks in the most efficient possible manner and at the highest possible throughput at low susceptibility to faults. The collection system should have a simple and low-maintenance design structure that is not susceptible to faults and should allow serially supplied objects to be stacked both in an ascending and a descending order. Using this collection system, it should also be possible to collect subgroups of flat objects, in particular including folded sheets or subgroups of folded sheets in the form of stacks.

These problems are addressed by the collection systems disclosed herein and by a method of collecting flat objects in the form of stacks as disclosed herein. Preferred embodiments of the collection systems according to the present invention and the method are also disclosed.

The collection system according to the present invention comprises at least two collection trays vertically disposed on top of each other, each collection tray forming a collection plane, with the collection planes running at a distance from and preferably parallel to each other. Each collection tray preferably has at least one horizontally disposed plane tray bottom, the surface of which defines the collection plane for depositing the objects or groups of groups (subgroups of objects comprising a plurality of individual objects). In addition, each of the collection trays has an entrance and an exit, with the objects or groups of objects being introduced through the entrance into the respective collection tray and with the objects or groups of objects collected therein in the form of stacks being removed through the exit.

The collection system according to the present invention further comprises a feeder unit for feeding individual objects or assembled groups of objects (subgroups comprising a plurality of objects) to the collection trays. The objects in question are flat and, in particular, sheet-shaped objects, for example, sheets of paper, in particular, printed sheets of paper. The objects involved can also be folded sheets or other flat objects, e.g., cards made of a paperboard or plastic material. The objects in question can be, for example, printed and optionally folded sheets of paper which constitute the content of a postal item and comprise a cover letter with the recipient's address and any associated enclosures. Using the collection system according to the present invention, the content of such a postal item can be collected in the form of a stack of sheets and can subsequently be inserted into an envelope by means of an envelope stuffing machine. The cover letter of such a postal item with the printed address of the recipient constitutes a leading document in the stack which preferably comes to lie on the upper surface or on the lower surface of the stack so that the printed address of the recipient is visible on the upper surface or on the lower surface of the stack. This is useful, for example, when the stack of sheets forming a postal item is inserted into an envelope with an address window.

In the collection system according to the present invention, the feeder unit and the collection trays can be moved or swiveled relative to one another. In particular, a transport element of the feeder unit on which the objects or groups of objects are transported is configured in such a manner that it can move or swivel relative to the collection trays. The transport element involved can be, for example, a revolving conveyor belt or a configuration of driven transport rollers. The movement of the feeder unit and the transport element thereof relative to the collection planes makes it possible to insert and deposit individual objects or assembled groups of objects, which are transported by means of the feeder unit or the transport element thereof to the collection trays, into a specific and predefined collection tray. To this end, for example, the feeder unit and the transport element can be moved in the vertical direction relative to the stationary collection trays or can be swiveled in the horizontal direction at an angle relative to said collection trays. By moving or swiveling the feeder unit and the transport element thereof and the collection trays relative to one another, the objects or subgroups of objects which are supplied by the feeder unit can be deposited in any (desired) predefined collection tray. Thus, it is possible, for example, to deposit the objects or groups of objects serially supplied by the feeder unit in an ascending or descending order in the collection trays disposed one on top of the other. This permits the objects to be collected in a stack both in an ascending and a descending order with respect to the transport sequence in which the individual objects or the groups of objects are fed by the feeder unit to the collection trays. Using the collection system according to the present invention, it is possible to load the collection trays in any order desired and to change the order as desired. This means, in particular, that the order of loading the collection trays is independent of the configuration and order of the collection trays disposed one on top of the other in the vertical direction.

To remove the objects or subgroups of objects deposited in the collection trays, the collection system according to the present invention comprises a conveyor unit. This conveyor unit preferably comprises one or a plurality of conveyor element(s) for removing the objects or groups of objects from the loaded collection trays. The conveyor unit is preferably configured such that it pushes all of the objects or groups of objects deposited in the loaded collection trays at the same time out of the collection trays. To this end, preferably at least one movable conveyor element is provided, which element simultaneously engages in all of the collection trays at predefined times and simultaneously pushes all of the objects or groups of objects deposited therein out of the collection trays. The movable conveyor element in question can be, for example, a slide which is attached to a movable belt or band. As the belt or band moves, the slide attached thereto simultaneously engages in all of the collection trays and pushes all of the objects or groups of objects deposited therein at the same time out of the collection trays.

As an alternative, a separate conveyor element can be assigned to each collection tray or to a plurality of collection trays, with the individual conveyor elements being connected to each other so that their movements are synchronized in such a manner that all of the conveyor elements simultaneously engage in their respectively assigned collection trays and simultaneously push out all of the objects or groups of objects deposited therein.

The simultaneous removal of the objects or groups of objects collected in the individual collection trays allows the objects to be very efficiently collected in the form of a stack while ensuring that the throughput of the collection system is very high. During the removal of the objects or groups of objects from the loaded collection trays, the individual stacks from the individual collection trays are stacked in the form a stack and preferably transferred to a stack receiving unit which is disposed downstream of the collection trays. The stack receiving unit preferably comprises a transport device for removing the stack formed. In addition, the stack receiving unit preferably also comprises a feed-through having a resilient element and a stationary element, through which feed-through the stack formed during the removal of the objects or groups of objects from the loaded collection trays is routed. The resilient element is preferably biased relative to the stationary element, for example, by a spring element or an elastic element, e.g., a rubber or foam roll, and the stationary element, at least compared to the resilient element, is configured so as to be resistant to deformation and immovably suspended. As the objects or groups of objects stacked to form the stack are routed through the feed-through, the stack pushes against the bias of the resilient element and thereby opens or enlarges a gap between the movable element and the stationary element, through which the stack can subsequently be routed. It is also possible to dispose a resilient element on both sides of the feed-through, which sides are pushed apart as the stack passes through, thereby opening or enlarging the gap between the two resilient elements.

To ensure that the individual objects or groups of objects in the form of a stack are uniformly oriented in the individual collection trays, each collection tray preferably has a limit stop. To this end, one or a plurality of stop elements can be provided, which stop elements engage in the collection trays as the objects or groups of objects are deposited therein and form a limit stop, with which the leading edge of the objects or groups of objects present in the collection tray comes into contact during deposition in the trays. Provision can be made for a single stop element which simultaneously engages in all of the collection trays or for a plurality of stop elements, with a separate stop element being assigned to each collection tray. Like the conveyor element or each conveyor element, the stop element or each stop element can be configured so as to be able to extend into the collection trays and to be retracted from the collection trays. The stop element or each stop element is preferably configured as a stopper which is attached to a revolving belt or band and engages in a collection tray or in each collection tray when the revolving belt or the revolving band moves into a specific engagement position.

As the objects or groups of objects are deposited in a collection tray, first the leading edge of the object or group of objects comes into contact with, and bounces off, the limit stop of the respective collection tray and subsequently drops onto the bottom of the respective collection tray or onto the sub-stack already contained thereon.

In the collection system according to the present invention, the feeder unit and the conveyor unit and the movement of the stop elements are preferably controlled by a central control unit.

To prevent that, as a result of the high kinetic energy of the object or group of objects, the object or a group of objects present in one of the collection trays is subjected to such a strong back jolt and bounces off the limit stop to such a degree that the object or the group of objects rebounds from the collection tray or becomes tangled up at the entrance of the collection tray, the present invention provides for a movable retaining element which is disposed at least temporarily at the entrance of the respective collection tray in order to close the entrance of the collection tray after an individual object or a group of objects has been deposited in the collection tray. The movement of the retaining element is preferably controlled by the control unit as well.

According to a preferred embodiment of the invention, the retaining element is disposed on the feeder unit and configured so as to be movable since the feeder unit which can be moved or swiveled relative to the collection trays is movable. To close the entrance of a collection tray, the feeder unit with the retaining element disposed thereon is moved away or swiveled away from the entrance of the collection tray as soon as an object or a group of objects has been deposited in the collection tray. At the same time, the retaining element is moved in front of the entrance of the collection tray, which causes said entrance to be closed. Closing the entrance of the collection tray prevents the object or the group of objects from rebounding from the collection tray as a result of the back jolt said objects are subjected to as they bounce off the limit stop.

To ensure that the entrance of the collection tray is closed by the retaining element immediately after an object or a group of objects has been deposited in the collection tray, it is useful to provide a sensor device which detects the entry of an object or a group of objects into the collection tray. The sensor device can be configured, for example, in the form of a light barrier or a touch sensor on the limit stop of the respective collection tray. As soon as an object or a group of objects in its full length has passed through the entrance of a collection tray, the sensor device generates a signal which is forwarded to the central control unit. The central control unit subsequently triggers a movement of the moveable retaining element which closes the entrance of the respective collection tray, for example, as already described above, by moving the feeder unit with the retaining element disposed thereon away from the collection tray and at the same time positioning the retaining element in front of the entrance of the collection tray. At the same time, the feeder unit is preferably moved into a position in which it is able to insert the subsequently following objects or groups of objects into another collection tray. This optimizes the throughput of the collection system.

BRIEF DESCRIPTION OF THE DRAWINGS

These and other features and advantages of the collection system according to the present invention follow from the practical example which is described in greater detail below with reference to the accompanying drawings, in which the figures show.

DETAILED DESCRIPTION

Figure 1:
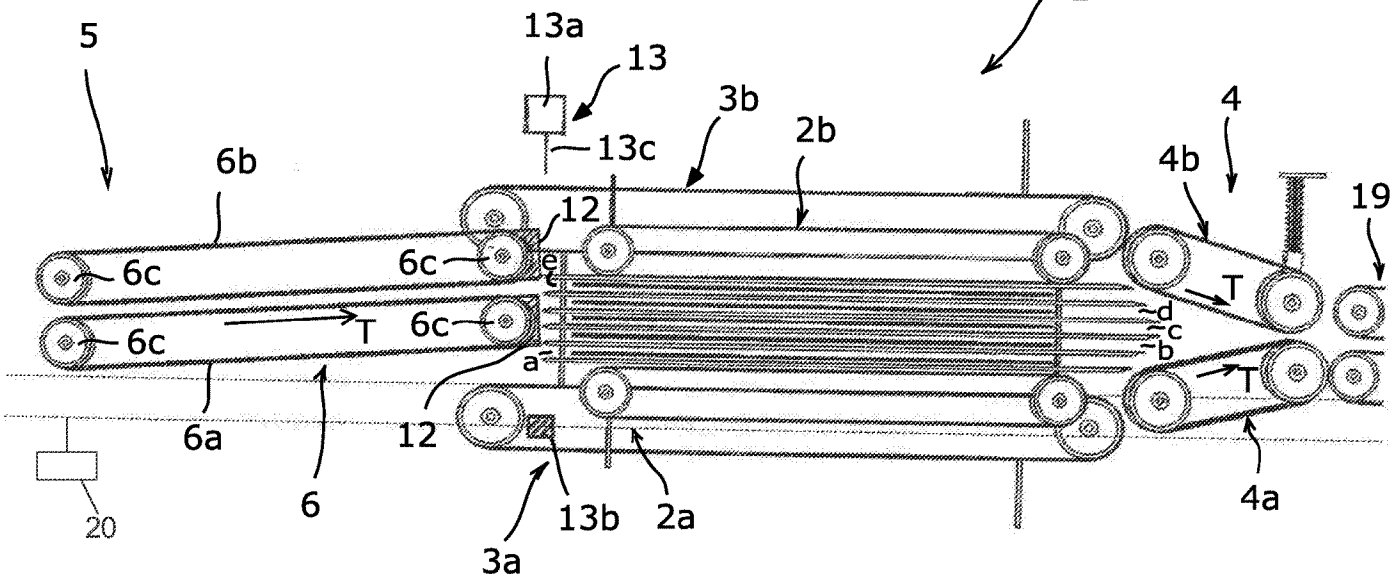
FIG. 1: A lateral view of a diagrammatically represented embodiment of a collection system according to the present invention, comprising a feeder unit and a plurality of collection trays.

FIG. 1 shows a diagrammatic representation of a collection system according to the present invention for collecting flat, in particular sheet-shaped, objects in the form of a stack. The collection system 1 comprises a feeder unit 5 for supplying individual objects G or groups of objects G' assembled from a plurality of such objects. A group of objects G' (subgroup of objects) can comprise, for example, 1 to 20 individual objects and is supplied by the feeder unit 5 as an already assembled subgroup in the form of a stack of objects. The individual objects G or groups of objects G', which can also include folded sheets or a folded subgroup, are serially transported in the feeder unit 5 along a transport direction. The feeder unit 5 preferably comprises a first transport path (not shown in the drawing) which is at least predominantly located in a horizontal plane, along which the objects G or the groups of objects G' are transported by means of a transport device, e.g., a conveyor belt or transport rollers. The feeder unit 5 further comprises a transport element 6 adjoining the first transport path downstream thereof, which transport element in the practical example shown in the drawing comprises two conveyor belts 6*a*, 6*b*, each revolving around rollers 6*c*, which conveyor belts are set in motion by the driven rollers 6*c*. The upper strand of the lower belt 6*a* and the lower strand of the upper belt 6*b* are disposed at a distance from and running parallel to each other, thereby creating a transport gap, through which the objects G or the groups of objects G' can be transported along a transport direction T.

On the downstream end of the feeder unit 5, retaining elements 12 are disposed. These retaining elements 12 can, for example, be plates which run at right angles to the transport direction and which preferably project slightly beyond the front rollers 6*c* of the transport element 6. The retaining elements 12 are preferably an integral part of a housing (not shown) in which the transport element 6 is disposed. FIGS. 1 to 4 show two retaining elements 12 which are disposed on the lower belt 6*a* and on the upper belt 6*b* of the transport element 6 and which, in the transport direction, project beyond the front rollers 6*c* of the conveyor belts 6*a*, 6*b*.

Figure 2:
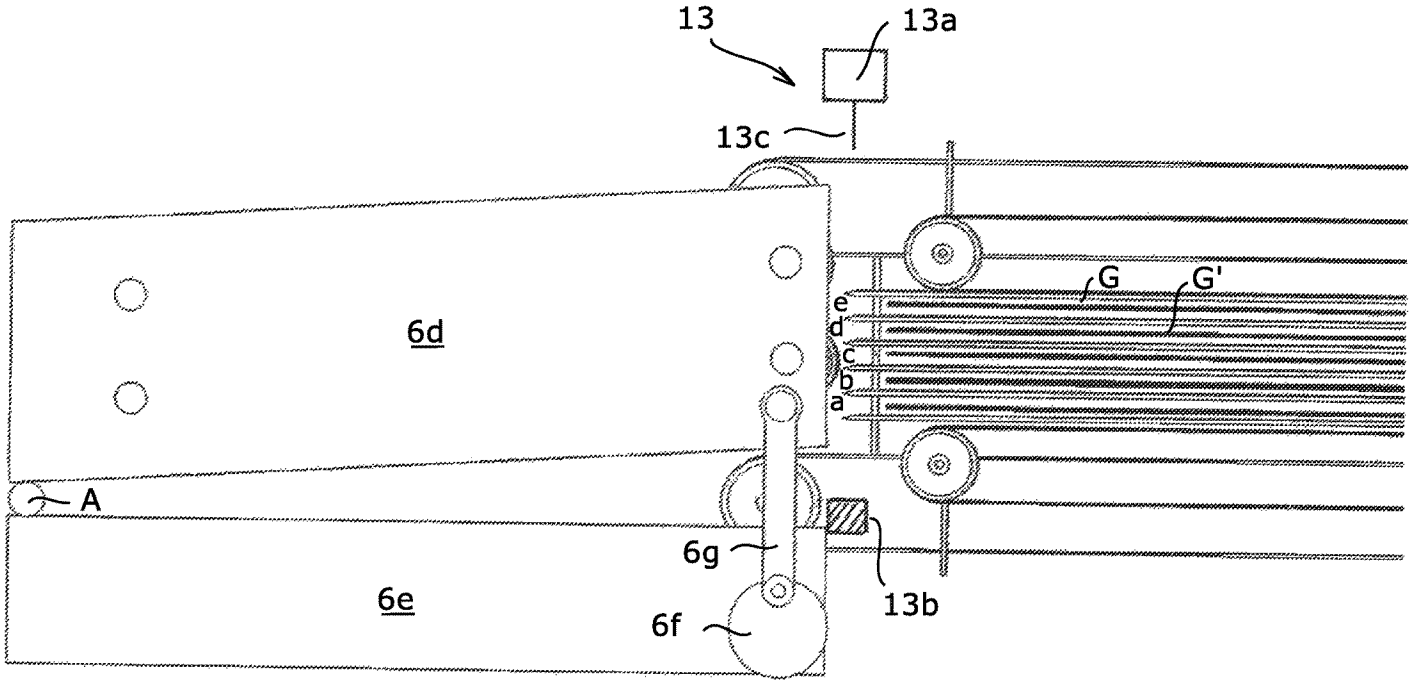
FIG. 2: A detail view of the feeder unit of the collection system of FIG. 1.

In the practical example shown in the drawing, the transport element 6 is configured so as to be swivelable and to this end comprises a frame section 6*d* which swivels about a swiveling axis A and which can be seen in FIG. 2. For the sake of clarity, the swivelable frame section 6*d* is not shown in FIG. 1, and in FIG. 2 hides the conveyor belts 6*a*, 6*b* disposed behind said section. The rollers 6*c* of the revolving conveyor belts 6*a*, 6*b* are rotatably disposed on the swivelable frame section 6*d*. The frame section 6*d* is swivelably hinged to a stationary frame section 6*e*. The swiveling axis A is disposed on the upstream end of the transport element 6. Disposed on the downstream end of the transport element 6 is a swivel mechanism which in the practical example shown is formed by an eccentric with an eccentric wheel 6*f* and an eccentric rod 6*g* hinged thereto. The eccentric wheel 6*f* which is driven by an eccentric drive (not shown) is rotatably mounted on the stationary frame section 6*e*. The lower end of the eccentric rod 6*g* is rotatably hinged to the eccentric wheel 6*f* in the area of its outside diameter, and the upper end of the eccentric rod 6*g* is rotatably mounted on the swivelable frame section 6*d*. By rotating the eccentric wheel 6*f*, the swivelable frame section 6*d* can be swiveled relative to the stationary frame section 6*e* within a predefined angular range (relative to the horizontal plane). By swiveling the swivelable frame section 6*d*, it is possible to adjust the position and especially the angle of tilt of the conveyor belts 6*a*, 6*b* relative to the horizontal plane and thereby the transport direction T of the transport element 6.

As FIGS. 1 and 2 indicate, a configuration with a plurality of collection trays a, b, c, d, e adjoins the region downstream of the transport element 6. In the vertical direction, the collection trays a, b, c, d, e are disposed one on top of the other, each comprising an entrance 10, an exit 11 and a plane tray bottom 9, the surface of which forms a collection plane. Thus, in the vertical direction, the collection planes of the collection trays a, b, c, d, e are disposed at a distance from and running parallel to each other, with the collection planes preferably being located at least predominantly in the horizontal plane. The collection planes of the individual collection trays a, b, c, d, e serve to support the objects G or the groups of objects G' that are supplied by the feeder unit 5 and especially by the transport element 6. The swivelability of the transport element 6 (especially of the swivelable frame section 6*d*) makes it possible to load the objects G or the groups of objects G' supplied by the transport element 6 into any collection tray a, b, c, d, e desired.

Figure 3A:
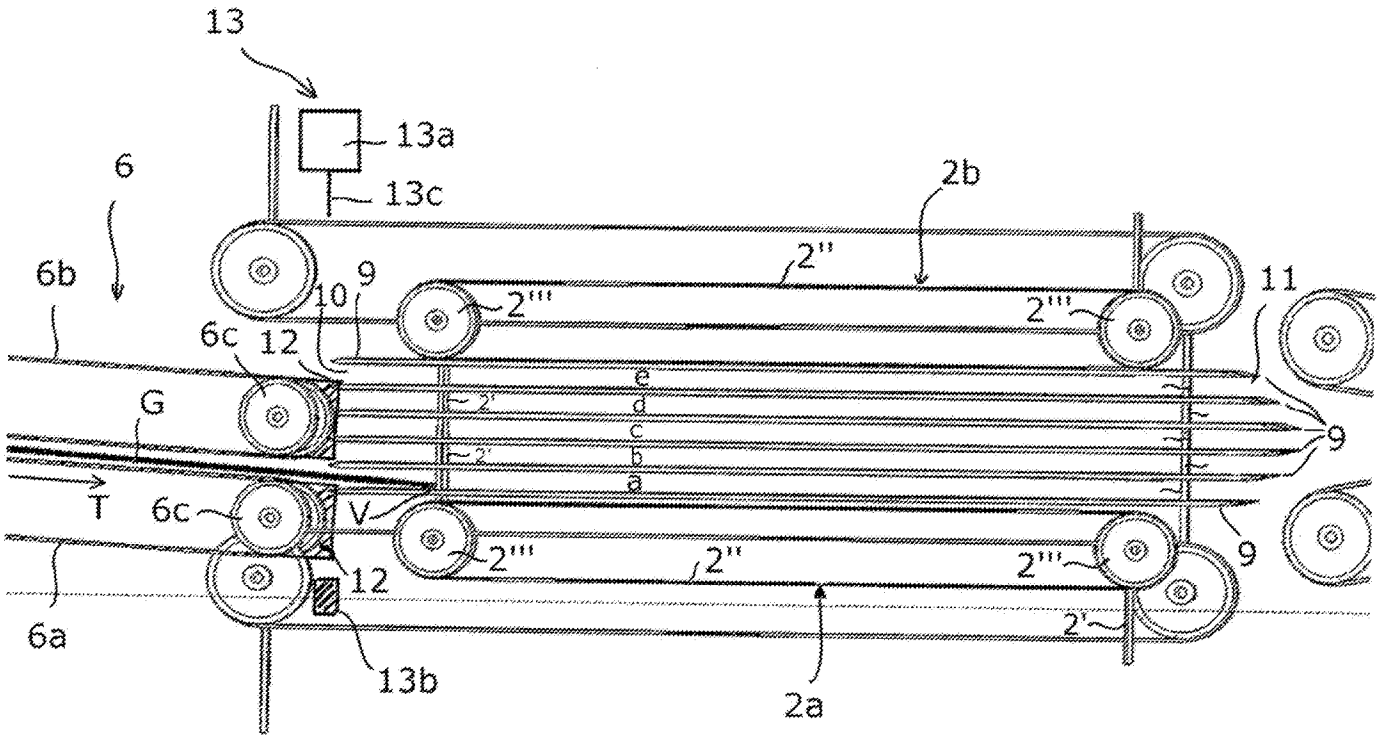
FIG. 3*a*: A detail view of the collection trays of the collection system of FIG. 1, with the associated feeder unit in a first position.

For the sake of clarity, FIG. 3*a* shows the swivelable transport element 6 in a first position in which an object G transported by the transport element 6 in the transport direction T is loaded into the lowermost collection tray a. To this end, the swivelable frame section 6*d* (FIG. 2) has been swiveled into its lowermost position in which the downstream end of the transport gap created between the belts 6*a* and 6*b* is approximately at the same level (relative to the vertical direction) as the collection plane of the lowermost collection tray a. Thus, in this position of the transport element 6, an object G routed by the transport element 6 in the transport direction T is loaded into the lowermost collection tray a and deposited therein.

In order to be able to detect the loading of an object into one of the collection trays, a sensor device 13 is provided, which detects the loading of an object or a group of objects into a collection tray. In the practical example shown, the sensor device 13 is formed by a light barrier with a light source 13*a* which emits a ray of light 13*c* and a photosensitive receiver 13*b* which detects the ray of light 13*c*. As soon as an object or a of group of objects in its full length has passed through the entrance 10 of a collection tray, the sensor device 13 generates a signal which is forwarded to the central control unit 20. The central control unit 20 subsequently triggers a movement of the moveable retaining elements 12, which movement causes the entrance 10 of the respective collection tray to be closed in that the feeder unit 5 with the retaining elements 12 disposed thereon is moved away from the collection tray into which an object has just been loaded and at the time causes a retaining element 12 to be positioned in front of the entrance 10 of the collection tray. At the same time, the feeder unit 5, and especially the transport element 6, is preferably moved into a position in which subsequently supplied objects or groups of objects can be routed into a different collection tray.

Figure 3B:
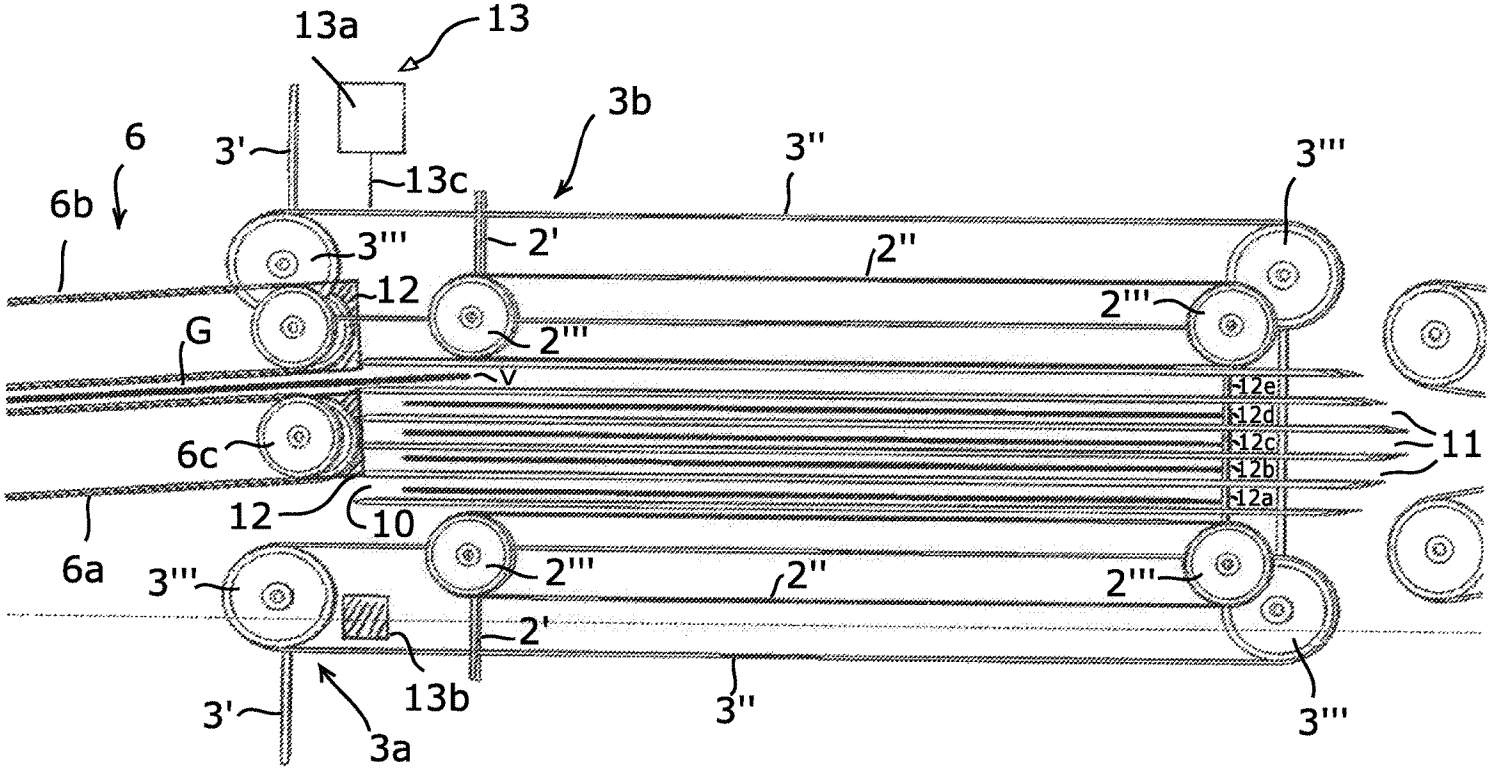
FIG. 3*b*: A detail view of the collection trays of the collection system of FIG. 1, with the associated feeder unit in a second position.

To ensure that when objects G or groups of objects G' are being deposited in a collection tray a, b, c, d, e, the objects or groups of objects deposited therein one on top of the other are uniformly oriented, each collection tray a, b, c, d, e comprises a stop element 2 which engages in the respective collection tray and forms a limit stop 12*a*, 12*b*, 12*c*, 12*d*, 12*e* with which the leading edge V of the objects G or the groups of objects G' comes into contact during deposition of said objects. FIG. 3*b* shows a stage at which the collection trays are being loaded, with the lowermost collection trays a, b, c and d already being loaded with objects G, the leading edge V of which rests against the respective limit stop 12*a*, 12*b*, 12*c*, 12*d* of the associated collection tray a, b, c, d. As the objects G or groups of objects G' are loaded into one of the collection trays a, b, c, d, e, the leading edge V of the object G or the subgroup of objects G' first comes into contact with the limit stop 12*a*, 12*b*, 12*c*, 12*d*, 12*e*, from which it subsequently bounces off. At the same time, the retaining element 12 which has been positioned in front of the entrance 10 of the collection tray prevents the object bouncing off the limit stop 12*a*, 12*b*, 12*c*, 12*d*, 12*e* from rebounding from the collection tray as a result of the back jolt.

The object G loaded into a collection tray a, b, c, d, e or the subgroup of objects G' loaded therein subsequently drops to the tray bottom 9 of the respective collection tray a, b, c, d, e or to a sub-stack of objects G already deposited thereon.

The stop element 2 in question can be, for example, a stopper 2' which is attached to a revolving stopper band 2". As the figures indicate, the revolving stopper band 2" is guided around rollers 2'" which are driven by a stopper drive. This allows the stop element 2 to extend into the collection trays a, b, c, d, e and to be subsequently retracted from the collection trays a, b, c, d, e. It is possible to provide for a single stop element 2 (in particular a single stopper 2') which is able to simultaneously engage in all or at least in a plurality of adjoining collection trays. However, it is also possible to assign a separate stop element, for example, a stopper 2', to each collection tray, which stop element engages only in the respectively assigned collection tray where it forms a limit stop 12*a*, 12*b*, 12*c*, 12*d*, 12*e*. In the practical example shown in the drawing, provision is made for a lower stop element 2*a* and an upper stop element 2*b*, with the lower stop element 2*a* being able to engage in the lower collection trays a, b and c and with the upper stop element 2*b* being able to engage in the upper collection trays c, d and e. However, it is also possible for each stopper band 2" to have a plurality of stoppers 2' attached to it, said stoppers being arranged in the longitudinal direction of the stopper band at a distance from one another. In the practical example shown in the drawing, two stoppers 2' each are disposed on each stopper band 2". This allows the stopper band 2" to be moved only in one direction, without having to change directions, in order to engage a stopper 2' in, or disengage it from, an assigned collection tray. The stopper or the stoppers 2' can conveniently be placed in any positions desired in the longitudinal direction (conveying direction) of the collection trays. This allows the position of the stop elements 2*a*, 2*b*, 2*c*, 2*d*, 2*e* in the collection trays to be adapted to the format of the objects, in particular, the dimensions of the objects in the conveying direction.

To be able to deposit individual objects G or groups of objects G' into collection trays b to e which are disposed above the lowermost collection tray a, the swivelable transport element 6 is swiveled in such a manner that its downstream end in the vertical direction comes to be positioned at the level of the collection tray into which the objects G or the groups of objects G' are to be loaded. FIG. 3*b*, for example, shows a position of the swivelable transport element 6, in which the objects G can be loaded into the uppermost collection tray e. The collection trays a, b, c, d disposed below are already loaded with objects G or groups of objects G', and their leading edge V rests against the limit stop 12*a*, 12*b*, 12*c*, 12*d* of the respective collection tray a, b, c, d.

After all of the objects G which are part of a group of objects have been loaded in a predefined order into the collection trays a, b, c, d, e, all of the collection trays a, b, c, d, e are emptied at the same time by simultaneously pushing all of the objects G or groups of objects G' deposited present in the loaded collection trays a, b, c, d, e through the exit 11 out of the collection trays by means of a conveyor unit. To remove the objects from the collection trays a, b, c, d, e, the conveyor unit preferably comprises a movable conveyor element 3 which engages in the collection trays so as to push all of the objects deposited therein (simultaneously) through the exit 11. To this end, a single movable conveyor element 3 can be used, which simultaneously engages in all of the collection trays and, by moving along a downstream conveying direction, simultaneously pushes all of the objects deposited in the collection trays out of the collection trays. It is, however, also possible to use two or more conveyor elements 3*a*, 3*b*, the movements of which are coupled and synchronized with one another so that all of the conveyor elements 3*a*, 3*b* simultaneously engage in the collection trays a, b, c, d, e and are moved through the collection tray in the conveying direction so as to ensure that all of the objects present in the collection trays are simultaneously pushed out of the collection trays. In the practical example shown in the drawing, a lower conveyor element 3*a* and an upper conveyor element 3*b* are provided, with the lower conveyor element 3*a* engaging in the lower collection trays (a, b, c) and with the upper conveyor element 3*b* engaging in the upper collection trays (c, d, e). Both the lower conveyor element 3*a* and the upper conveyor element 3*b* comprise a slide element 3' which is attached to a revolving slide band 3". The revolving slide band 3" is guided around drivable rollers 3'" and is set in motion by the drive of the rollers 3'".

To remove the collected objects G or groups of objects G' from the loaded collection trays, the movable conveyor elements 3 and 3*a*, 3*b* are set and actuated at predefined times so that they simultaneously engage in the collection trays and are moved through the collection trays in order to simultaneously push all of the objects or groups of objects deposited present out of the loaded collection trays. If a plurality of movable conveyor elements 3*a*, 3*b* are used, the movements of these elements are synchronized in such a way that all of the conveyor elements 3*a*, 3*b* simultaneously engage in the respectively assigned collection trays. In the practical example mentioned above, in which a single movable conveyor element 3 is used, this conveyor element 3 automatically engages in all of the collection trays a, b, c, d, e at the same time.

Each slide element 3" can have a plurality of slides 3' attached to it, said slides being disposed at a distance from one another in the longitudinal direction of band. In the practical example shown in the drawing, two slides 3' each are disposed on each slide band 3". This allows the slide band 3" to be moved only in one direction, without having to change directions, in order to engage a slide 3' in, or disengage it from, a respectively assigned collection tray. This contributes to an increase in the throughput since the second slide 3' can be used immediately to remove the next stack from the collection trays as soon as the first slide 3' has been disengaged from the collection trays.

Figure 4:
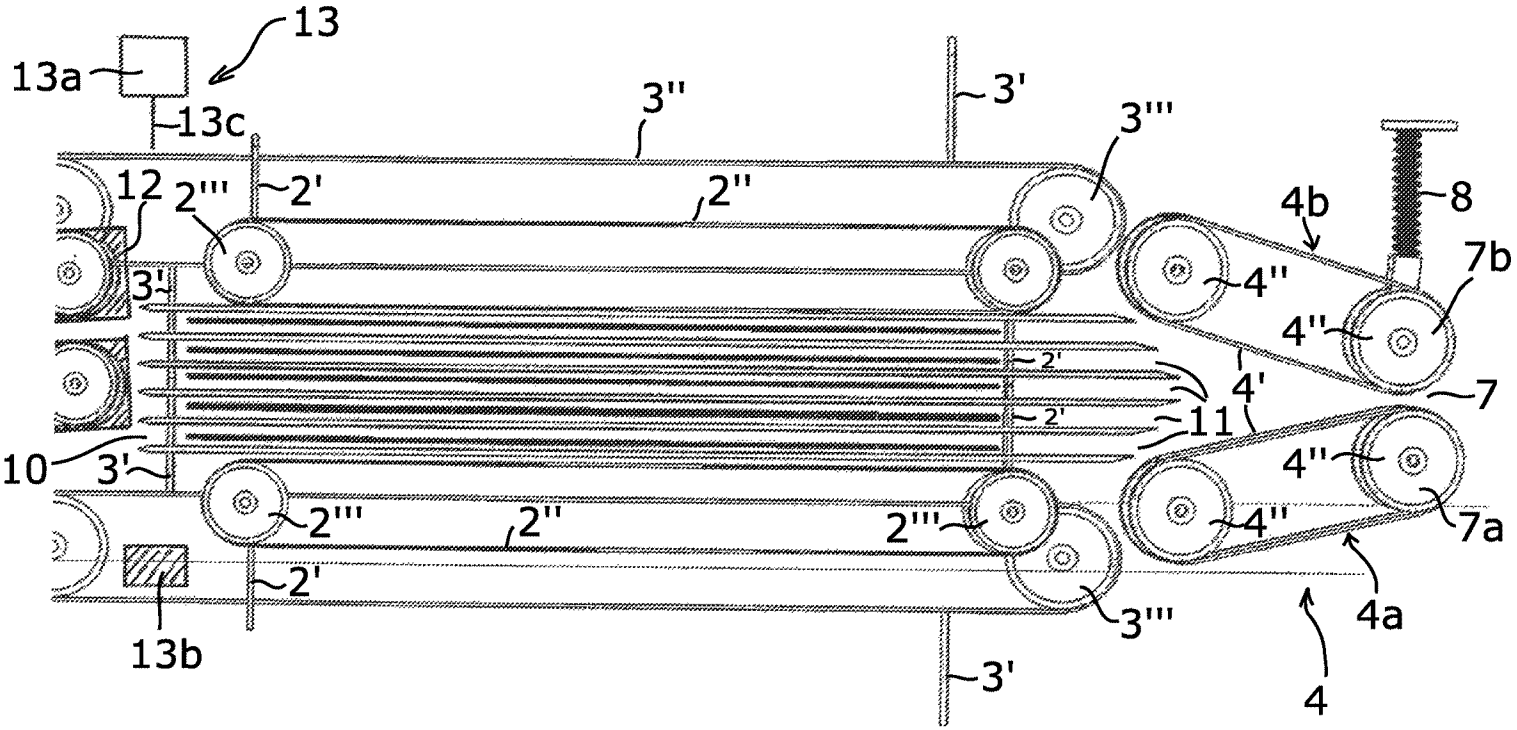
FIG. 4: A detail view of the collection trays of the system of FIG. 1 in the loaded state.

To ensure that the stop elements 2 and 2*a*, 2*b* do not obstruct the removal of the objects from the collection trays, these stop elements are retracted before the objects are removed from the collection trays. In FIG. 4, the collection system 1 is shown in a position in which the collection trays a, b, c, d, e are loaded with objects G and the objects are ready to be removed. In the position shown in FIG. 4, the stop elements 2, and especially the stoppers 2', are still engaged in the collection trays a, b, c, d, e. To remove the objects G from the collection trays a, b, c, d, e, first the stop elements 2, especially the stoppers 2', are retracted from the collection trays. Subsequently or at the same time, the conveyor elements 3, in particular the slides 3', move into the upstream end of the collection trays a, b, c, d, e and through the collection trays in the downstream direction. In the course of this, all of the objects deposited in the collection trays a, b, c, d, e are simultaneously pushed in the conveying direction to the downstream end of the collection trays.

Disposed on the downstream end of the collection trays a, b, c, d, e is a stack receiving unit 4. In the practical example shown in the drawing, this unit comprises a lower conveyor unit 4*a* and an upper conveyor unit 4*b*, each of which comprises a conveyor belt 4' which revolves around driven rollers 4", with the lower conveyor belt 4' slanting upwardly and with the upper conveyor belt 4' slanting downwardly when viewed in the downstream direction and relative to the horizontal plane. The upper conveyor unit 4*b* comprises a resilient element 7*a* which is formed by the downstream roller 4". This resilient element 7*b* is biased relative to a stationary element 7*a* by a spring element 8. The stationary element 7*a* is formed by the downstream roller 4" of the lower transport unit 4*a*. In a baseline position, the stationary element 7*a* and the resilient element 7*b* are disposed at a distance from each other in such a way that a gap between the stationary element 7*a* and the resilient element 7*b* is created. This gap forms a feed-through 7, through which the stack formed by the collection system 1 and forming a finished group of objects can be routed so as to remove the stack.

Figure 5A:
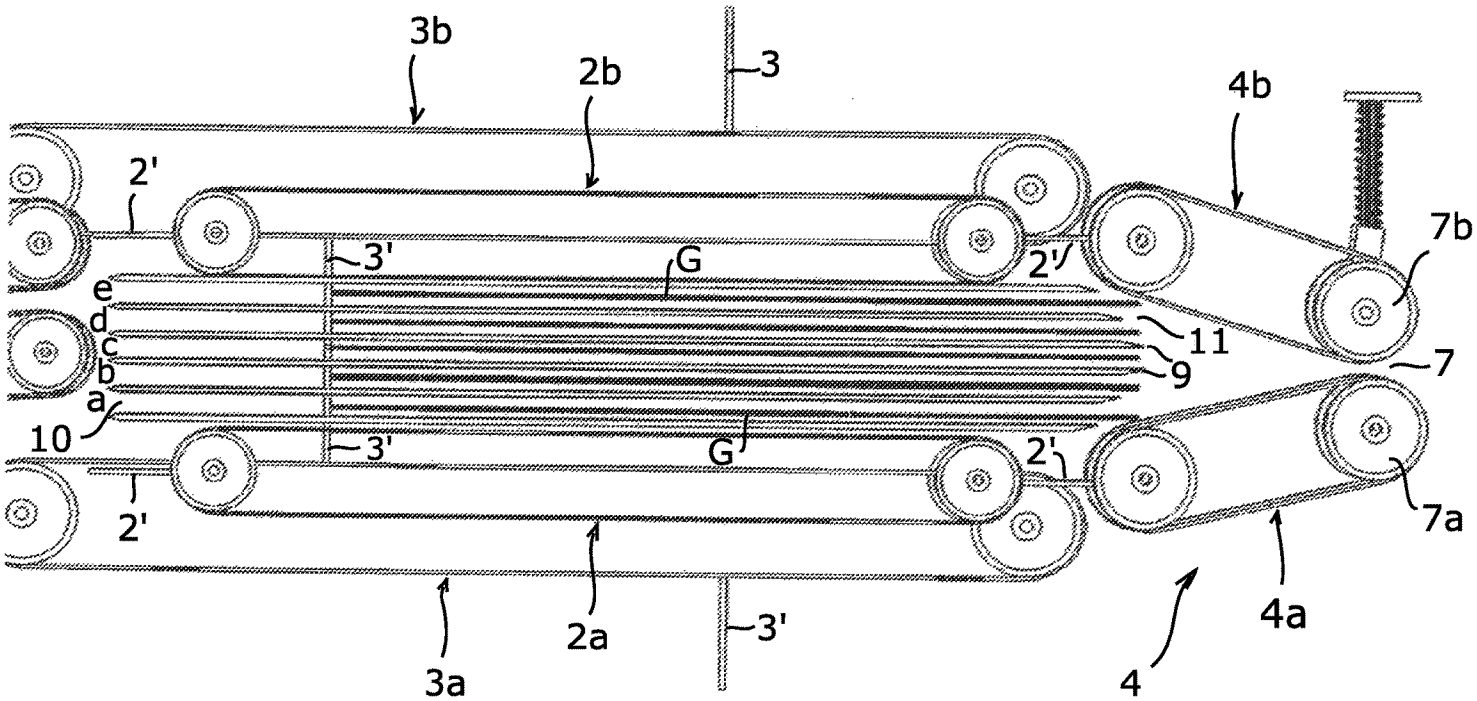
FIG. 5*a*: A detail view of the collection trays of the system of FIG. 1 during the removal of the objects or groups of objects deposited therein in a first stage
Figure 5B:
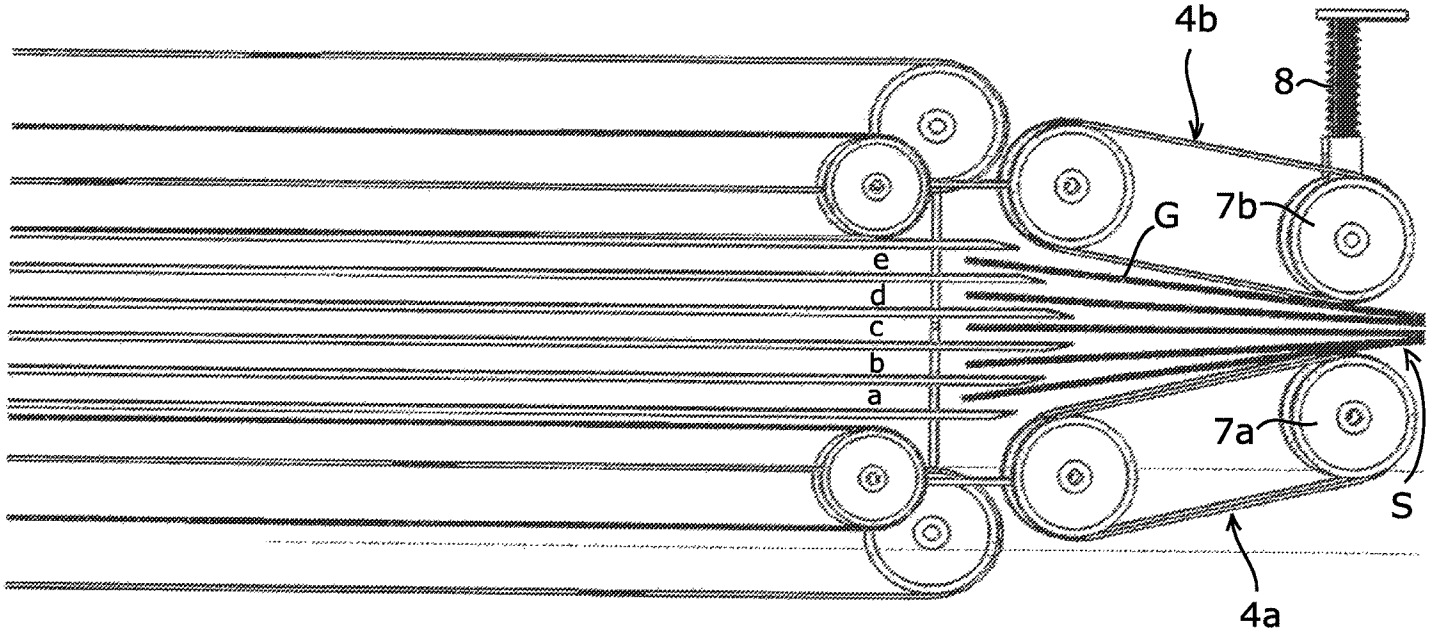
FIG. 5*b*: A detail view of the collection trays of the system of FIG. 1 during the removal of the objects or groups of objects deposited therein in a second stage.

In FIG. 5, two consecutive stages of the removal of the objects from the collection tray a, b, c, d, e and the simultaneously occurring formation of stack S and the removal of the formed stack S are shown. The representation in FIG. 5*a* shows how the conveyor element 3 and the two conveyor elements 3*a*, 3*b* simultaneously push all of the objects G contained in the collection trays a, b, c, d, e in the downstream direction out of the collection trays. By slanting the conveyor belts 4*a*, 4*b*, respectively, upwardly and downwardly as shown in the drawings of FIG. 5, the objects G removed from the collection trays are made to converge in the vertical direction so as to form a stack S and are routed by the conveyor belts 4' which are moving in the transport direction T through the feed-through 7 which is formed by the gap between the stationary element 7*a* and the resilient element 7*b*. This causes the resilient element 7*b* to be pushed upwardly against the elastic recovery force of the spring element 8. The elastic recovery force of the spring element 8 and the elastic property of the resilient element 7*b* ensure that the objects G forming stack S are subjected to high pressure and thus are compacted to form stack S. The feed-through 7 is adjoined downstream by a removal unit 19 for the removal of the formed stack S (FIG. 1).

Figure 6:
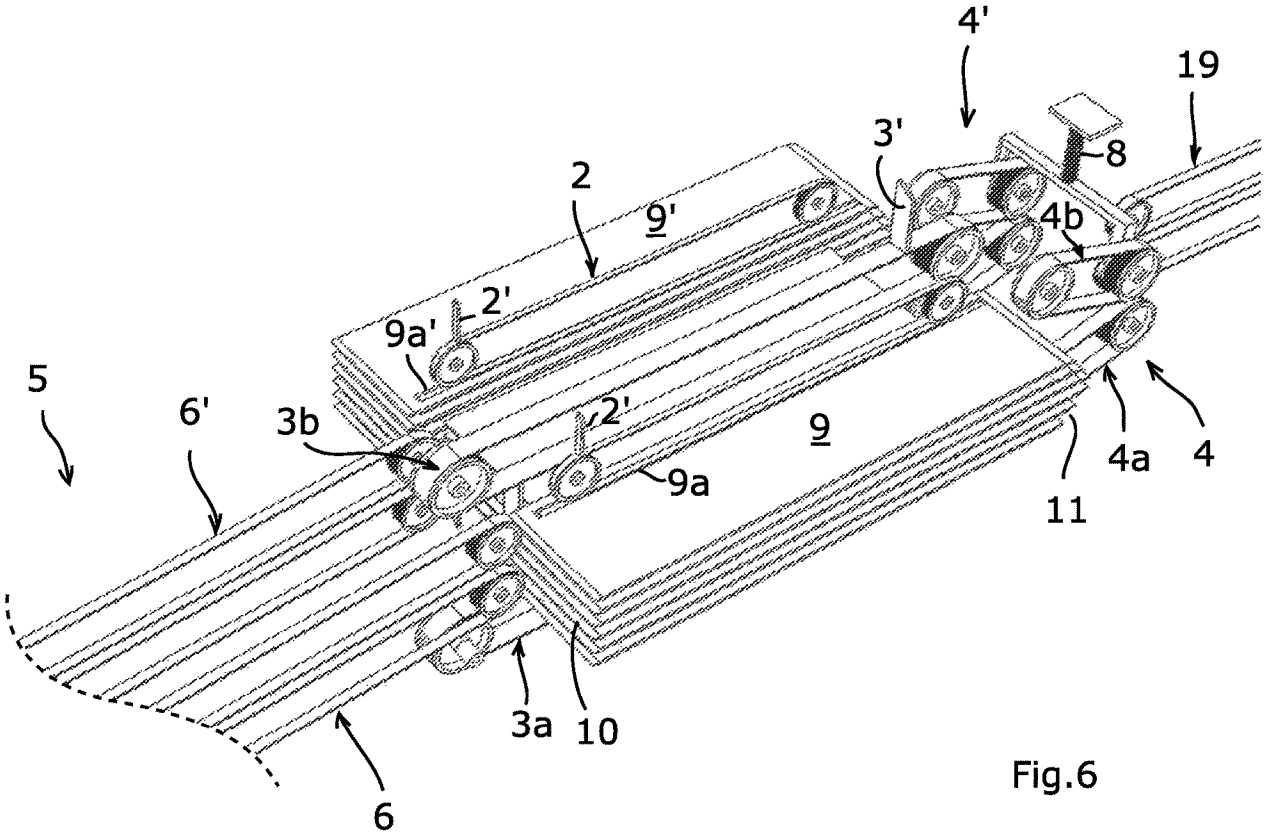
FIG. 6: A perspective top view of a preferred embodiment of a collection system according to the present invention.
Figure 7:
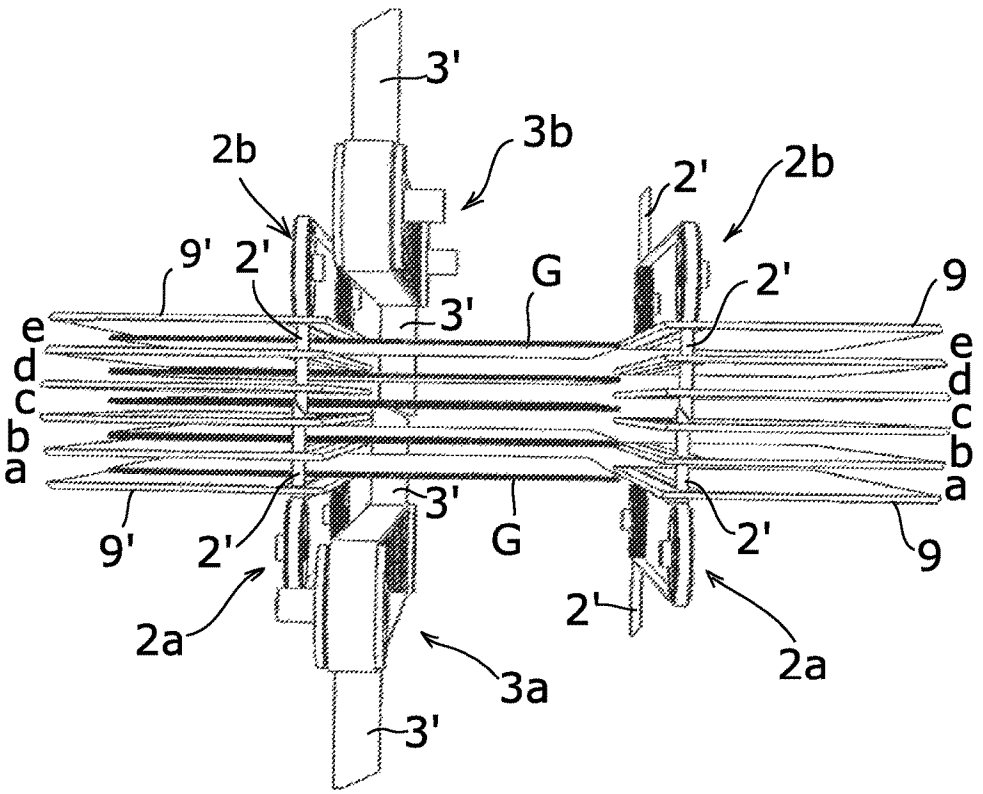
FIG. 7: A view of the collection trays of the collection system of FIG. 6 in the conveying direction.

FIGS. 6 and 7 illustrate a modified embodiment of a collection system. In this system, each collection tray a, b, c, d, e comprises two tray bottoms 9, 9' that are separated from each other.

The tray bottoms 9, 9' of a collection tray a, b, c, d, e are disposed at a distance from each other at right angles relative to the transport direction, thereby creating a gap between the tray bottoms 9, 9' of a collection tray. Disposed in this gap is the conveyor unit with the conveyor elements 3 and 3*a*, 3*b*, for removing the objects from the collection trays. More specifically, disposed in this gap are the lower conveyor element 3*a* and the upper conveyor element 3*b* with the respectively associated slides 3' which pass across the collection planes of the collection trays a, b, c, d, e. Disposed in each of the tray bottoms 9, 9' of a collection tray a, b, c, d, e is a slot 9*a*, 9*a*', through which the movable stop elements 2, in particular the stoppers 2', pass and thereby are able to engage in the respective collection tray a, b, c, d, e. The two tray bottoms 9, 9' of a collection tray a, b, c, d, e can preferably be moved relative to each other at right angles to the transport direction. This, for example, allows the stop elements 2 and/or the conveyor elements 3; 3*a*, 3*b* to be replaced in case they are damaged by wear. In addition, the movable configuration of the tray bottoms 9, 9' at right angles to the transport direction allows the width of the collection trays a, b, c, d, e to be adjusted to the format of the objects G to be collected. As shown in FIG. 5, in this practical example of the collection system, preferably two separate transport elements 6, 6' are provided upstream of the divided collection trays, which transport elements are disposed at a distance from each other at right angles to the conveying direction. In correspondence thereto, downstream of the divided collection trays, two separate stack receiving units 4, 4' are provided, which are disposed at a distance from each other at right angles to the conveying direction.

The invention is not limited to the embodiments represented in the drawings. Instead of the configuration of the retaining elements 12 on the feeder unit 5 described above and represented in FIGS. 1 to 4, different configurations of the retaining elements 12 can be used. The retaining elements 12 can also take the form of movable flaps or baffles which are moved in front of the entrance 10 of a collection tray a to d after an object has been inserted. The flaps or baffles can, for example, be moved vertically from the top to the bottom or laterally in front of the entrance 10 of a collection tray a to d. To prevent the back jolt from causing the just loaded object to rebound from the collection tray, it suffices if at least part of the entrance 10 of the collection tray is closed by a retaining element 12.

Instead of configuring the feeder unit 5 and, in particular, the transport element 6 so as to be swivelable relative to the stationary collection trays a, b, c, d, e as shown in the figure, it is also possible to configure the feeder unit 5 and, in particular, the transport element 6 thereof so as to be movable in the vertical direction relative to the collection trays a, b, c, d, e. In this embodiment of the system according to the present invention, the feeder unit 5 and, in particular, the transport element 6 thereof can be moved in the manner of a lift in the vertical direction between the lowermost collection tray a and the uppermost collection tray e, in order to allow objects to be deposited into any of the collection trays and in any sequence desired. As an alternative, it is also possible to configure the feeder unit 5 and, in particular, the transport element 6 thereof so as to be stationary and to configure the collection trays so as to again be movable in the manner of a lift in the vertical direction.

Instead of the conveyor unit 3 with the synchronously movable conveyor elements 3*a*, 3*b* which has been described in detail above, it is also possible to use different conveyor units for the removal of the objects from the collection trays, for example, driven rollers or belts. These are synchronously driven for the simultaneous removal of all of the objects from the loaded collection trays so that all of the objects can be simultaneously removed from the collection trays.

In contrast to the configuration shown in FIGS. 6 and 7, the collection trays can also have full-length tray bottoms 9. To enable the conveyor elements 3*a*, 3*b* (in particular their slides 3') and the stop elements 2 (in particular their stoppers 2') to engage [in the collection trays], slots extending in the longitudinal direction (conveying direction) of the tray bottoms 9 can be provided.

In addition, it is possible to arrange a plurality of collection systems of the type described above one behind the other in the conveying direction. On the one hand, this makes it possible to collect large stacks with a high number of objects since it allows sub-stacks to be formed already in a first collection system, which sub-stacks can subsequently be deposited into a collection tray of the second collection system downstream and be combined with additional objects or sub-stacks of objects to form a larger stack. On the other hand, it allows the total number of collection trays to be increased without excessively increasing the dimensions of the system. Preferably, the stack receiving unit of the first collection system is immediately adjoined downstream by the feeder unit of the second collection system, etc. It is, however, also possible to dispose additional processing stations between consecutively disposed collection systems.

What is claimed is:

1. A system for collecting objects and forming the collected objects into at least one stack, the system comprising:

a plurality of collection trays arranged one on top of another in a vertical direction, each tray of the plurality of collection trays having an entrance and an exit;

a feeder unit configured and arranged for feeding an individual object or an assembled group of objects to the entrance of a tray of the plurality of collection trays and depositing the individual object or assembled group of objects into the tray;

a transport element included within the feeder unit having a surface for supporting the individual object or an assembled group of objects, the transport element swivel-mounted with respect to the plurality of collection trays and configured such that the surface can be swiveled into a position in which the individual object or an assembled group of objects supported on the surface of the transport element can be deposited into any tray of the plurality of collection trays;

a stop element extendable into and retractable from each tray of the plurality of collection trays, the stop element engaging the tray to form a limit stop for contacting a leading edge of the individual object or of the assembled group of objects during deposition of the individual object or assembled group of objects into each tray;

a moveable retaining element at a downstream end of the feeder unit, the moveable retaining element moveable between an open position opening the entrance of each tray of the plurality of collection trays for deposition of the individual object or assembled group of objects into each tray and a closed position closing the entrance of each tray after the individual object or assembled group of objects has been deposited into the tray, the moveable retaining element, in the open position, configured to retain the individual object or assembled group of objects in each tray by preventing rebounding of the individual object or assembled group of objects into the entrance of the tray during depositing of the individual object or assembled group of objects into each tray; and a conveyor unit configured and arranged for removing the individual objects or assembled groups of objects deposited into the plurality of collection trays through the exits of the trays and for forming at least one stack from the individual objects or assembled groups of objects removed from the trays.

2. The system according to claim 1, further comprising a central control unit, the central control unit configured for controlling the feeder unit, the conveyor unit, movement of the stop element, and movement of the retaining element.

3. The system according to claim 1, wherein the conveyor unit is configured and arranged for removing all of the individual objects or assembled groups of objects deposited into the plurality of collection trays at the same time.

4. The system according to claim 1, wherein the conveyor unit comprises at least one conveyor element configured and arranged for engaging each tray of the plurality of collection trays and for pushing all of the individual objects or assembled groups of objects deposited into the plurality of collection trays out of the collection trays at the same time.

5. The system according to claim 4, wherein the at least one conveyor element is a slide element attached to a moveable belt or band, the slide element configured for engaging each tray of the plurality of collection trays as the belt or band moves in the conveyor unit.

6. The system according to claim 1, wherein each tray of the plurality of collection trays has a bottom surface substantially horizontally disposed, the bottom surface defining a plane for receiving the individual object or assembled group of objects.

7. The system according to claim 1, wherein the transport element is configured for swiveling in a vertical direction and for swiveling in a predefined angular range relative to a horizontal plane.

8. The system according to claim 1, wherein the movable retaining element is integral with the feeder unit or is disposed on the feeder unit.

9. The system according to claim 2, further comprising a sensor device configured for detecting presence of the individual object or assembled group of objects in a tray of the plurality of collection trays.

10. The system according to claim 9, wherein the sensor device comprises a light source configured for emission of light rays and a photosensitive receiver configured to receive light rays emitted by the light source.

11. The system according to claim 9, wherein the sensor device is configured for generating a signal and transmitting the signal to the central control unit when the presence of the individual object or assembled group of objects is detected in a tray of the plurality of collection trays.

12. The system according to claim 11, wherein the moveable retaining element is configured and arranged to move toward the closed position, upon activation by the central control unit, to at least partially close the entrance of the tray in which the presence of the individual object or assembled group of objects has been detected.

13. The system according to claim 1, further comprising a stack-receiving unit downstream of the plurality of collection trays, the stack-receiving unit configured for receiving and transporting stacks of objects formed by the conveyor unit.

14. The system according to claim 1, wherein the movable retaining element is a plate positioned at a right angle to a transport direction of the individual object or assembled group of objects.

15. The system according to claim 1, wherein the stop element is configured as a stopper attached to a revolving belt.

16. A system for collecting objects and forming the collected objects into at least one stack, the system comprising:

a plurality of collection trays arranged one on top of another in a vertical direction, each tray of the plurality of collection trays having an entrance and an exit;

a feeder unit configured and arranged for feeding an individual object or an assembled group of objects to the entrance of a tray of the plurality of collection trays and depositing the individual object or assembled group of objects into the tray;

a plurality of stop elements engageable with the plurality of collection trays, each stop element of the plurality of stop elements extendable into and retractable from each tray of the plurality of collection trays to form a limit stop in each tray for contacting a leading edge of the individual object or of the assembled group of objects during deposition of the individual object or assembled group of objects into each tray;

a transport element included within the feeder unit having a surface for supporting the individual object or an assembled group of objects, the transport element swivel-mounted with respect to the plurality of collection trays and configured such that the surface can be swiveled into a position in which the individual object or assembled group of objects supported on the surface of the transport element can be deposited into any tray of the plurality of collection trays; and a conveyor unit configured and arranged for removing all of the individual objects or assembled groups of objects deposited into the plurality of collection trays at the same time and for forming at least one stack from the individual objects or assembled groups of objects removed from the trays.

* * * * *